US006136752A

United States Patent [19]

Paz-Pujalt et al.

[11] Patent Number: 6,136,752

[45] Date of Patent: Oct. 24, 2000

[54] RECEIVER HAVING AUTHENTICATING MARKS

[75] Inventors: Gustavo R. Paz-Pujalt, Rochester; David L. Patton, Webster; John R. Fredlund, Rochester, all of N.Y.

[73] Assignee: Eastman Kodak Company, Rochester, N.Y.

[21] Appl. No.: 09/165,066

[22] Filed: Oct. 2, 1998

[51] Int. Cl.[7] ..... B41M 5/035; B41M 5/38

[52] U.S. Cl. ..... 503/227; 428/195; 428/913; 428/914; 428/42.1; 428/354

[58] Field of Search ..... 8/471; 428/195, 428/913, 914, 42.1, 354; 503/227

[56] References Cited

U.S. PATENT DOCUMENTS

| | | | |
|---|---|---|---|
| Re. 33,260 | 7/1990 | Stephenson | 346/76 PH |
| 4,720,480 | 1/1988 | Ito et al. | 503/227 |
| 5,380,695 | 1/1995 | Chiang et al. | 503/227 |
| 5,752,152 | 5/1998 | Gasper et al. | 399/366 |
| 5,768,674 | 6/1998 | Gas per et al. | 399/366 |
| 5,772,250 | 6/1998 | Gasper | 283/114 |

OTHER PUBLICATIONS

*Graphic Arts Manual,* Arno Press, Musarts Publishing Corp., New York, New York, 1980.

"Inks in Common Use", Theodore Lustig, Sun Chemicals Corp.

*Introduction to Printing Inks,* Gary G. Winters, Inmont Corporation.

*Primary Examiner*—Bruce H. Hess

*Attorney, Agent, or Firm*—Raymond L. Owens

[57] ABSTRACT

A method of forming authentic user viewable images on a receiver to which a series of viewable images such as postal stamps are adapted to be transferred including providing a receiver, and forming a series of authentic user viewable marks on the receiver prior to transfer of the series of images onto such receiver.

6 Claims, 7 Drawing Sheets

RECEIVER HAVING AUTHENTICATING MARKS

FIELD OF THE INVENTION

The present invention relates to authenticating a series of images on a receiver such as a series of postal stamps.

BACKGROUND OF THE INVENTION

Heretofore images of high quality have been produced by thermal printers. In a typical thermal printer an image is formed in three passes. First a dye donor having color such as yellow is placed in dye transfer relationship with a receiver and then the dye donor is heated in a pattern corresponding to the yellow portion of an image to be completed. Thereafter, cyan and magenta portions of the image are formed in a similar fashion. The completed color image on the receiver is continuous tone and in many cases can rival photographic quality.

In one type of thermal printer which prints colored images, a donor contains a repeating series of spaced frames of different colored heat transferable dyes. The donor is disposed between a receiver, such as coated paper, and a print head formed of, for example, a plurality of individual heating resistors. When a particular heating resistor is energized, it produces heat and causes dye from the donor to transfer to the receiver. The density or darkness of the printed color dye is a function of the energy delivered from the heating element to the donor.

Thermal dye transfer printers offer the advantage of true "continuous tone" dye density transfer. This result is obtained by varying the energy applied to each heating element, yielding a variable dye density image pixel in the receiver.

Thermally printed images are used in a number of different applications. In one of those applications, so-called "sticker prints" are made on a receiver and arranged so that they can be peeled off and individually pasted onto another surface. However, these stickers are not used in situations which require that they be "authentic". By use of the term "authentic" is meant that the image can indicate to a viewer or a reader with a high degree of certainty that the image has not been counterfeited.

SUMMARY OF THE INVENTION

It is an object of the present invention to authenticate images formed in a receiver.

This object is achieved in a method of forming authentic user viewable images on a receiver to which a series of viewable images such as postal stamps are adapted to be transferred, comprising the steps of:

a) providing a receiver; and b) forming a series of authentic user viewable marks on the receiver prior to transfer of the series of images onto such receiver.

An advantage of the present invention is that it effectively authenticates images preventing counterfeiting, misuse or fraud.

A feature of the present invention is that authenticating marks are formed in the receiver prior to forming a series of images. The marks are formed which authenticate images and these marks can be in the form of a bar code, an official seal, alphanumeric data or encoded digitized information.

It is an important feature of the present invention that marks are formed which provide marks in the support of an image receiving structure of the receiver. These marks can either be viewable under ambient lighting conditions which can include holograms or not viewable under such conditions. In the latter case, the marks can be formed of fluorescent materials which fluoresce under certain lighting conditions. A further feature of the invention is that the marks can be in the form of silver impregnated threads or magnetic strip material or in an encoded form that requires a device such as a bar code reader to scan the images and decode the authenticating marks. The marks can form water marks.

Another feature of the invention is that the marks can be embossed.

Another feature of the present invention is that it facilitates the design of images to be authenticated such as postage stamps, travelers checks, checks and other types of official documents.

DETAILED DESCRIPTION OF THE INVENTION

Figure 1:
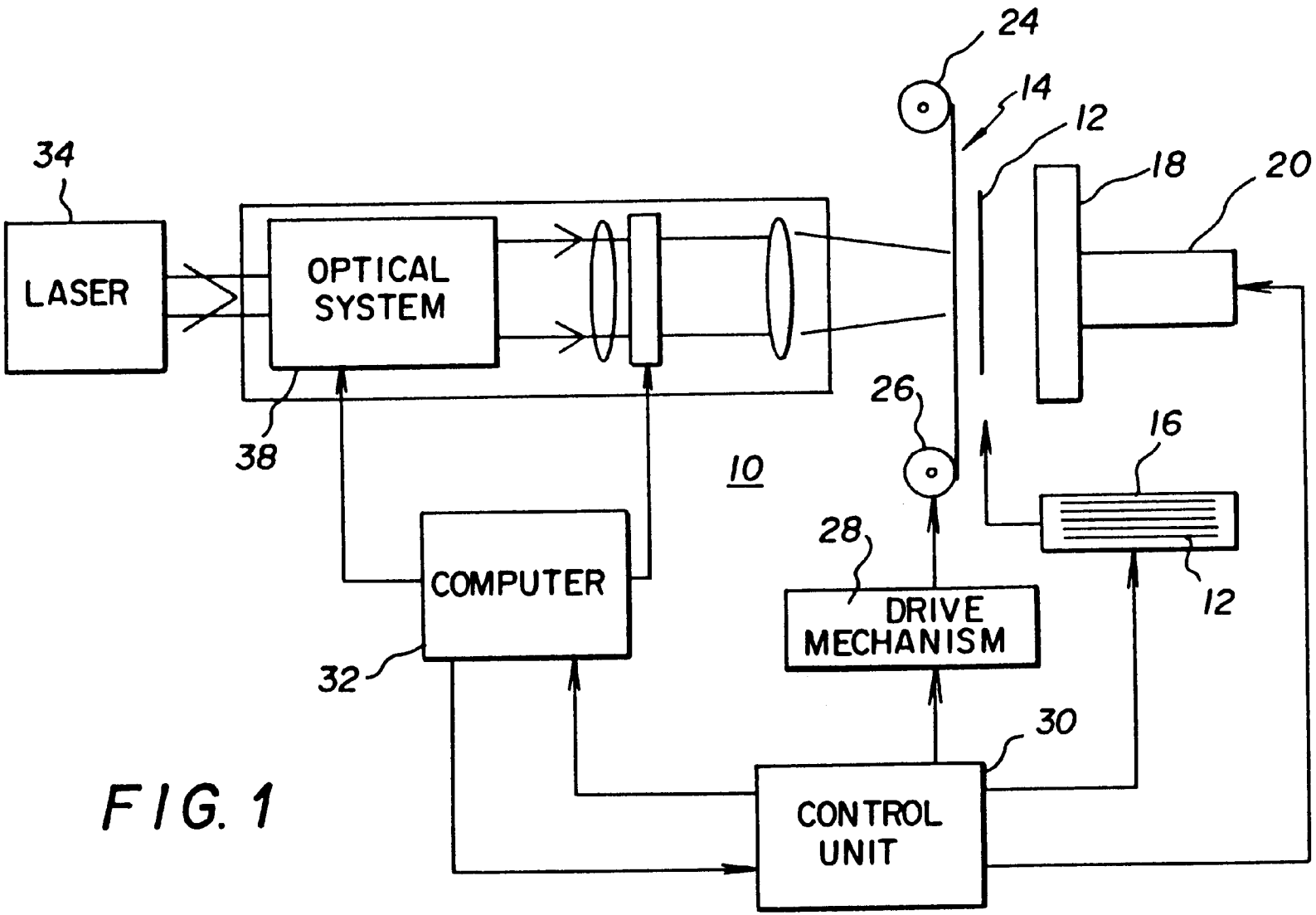
FIG. 1 is a schematic block diagram of a thermal printing apparatus which makes colorant images on a receiver in accordance with the present invention.

Referring to FIG. 1 shows a thermal printer apparatus 10 which employs a receiver 12 and a colorant donor element 14 in the form of a web. Receiver 12, in the form of a sheet is serially fed from a tray 16 to a print position by a conventional sheet feeding mechanism, not shown. As used herein the term "colorant" can include dyes, pigments or inks which can be transferred from the colorant donor element 14 to a receiver 12.

Figure 2:
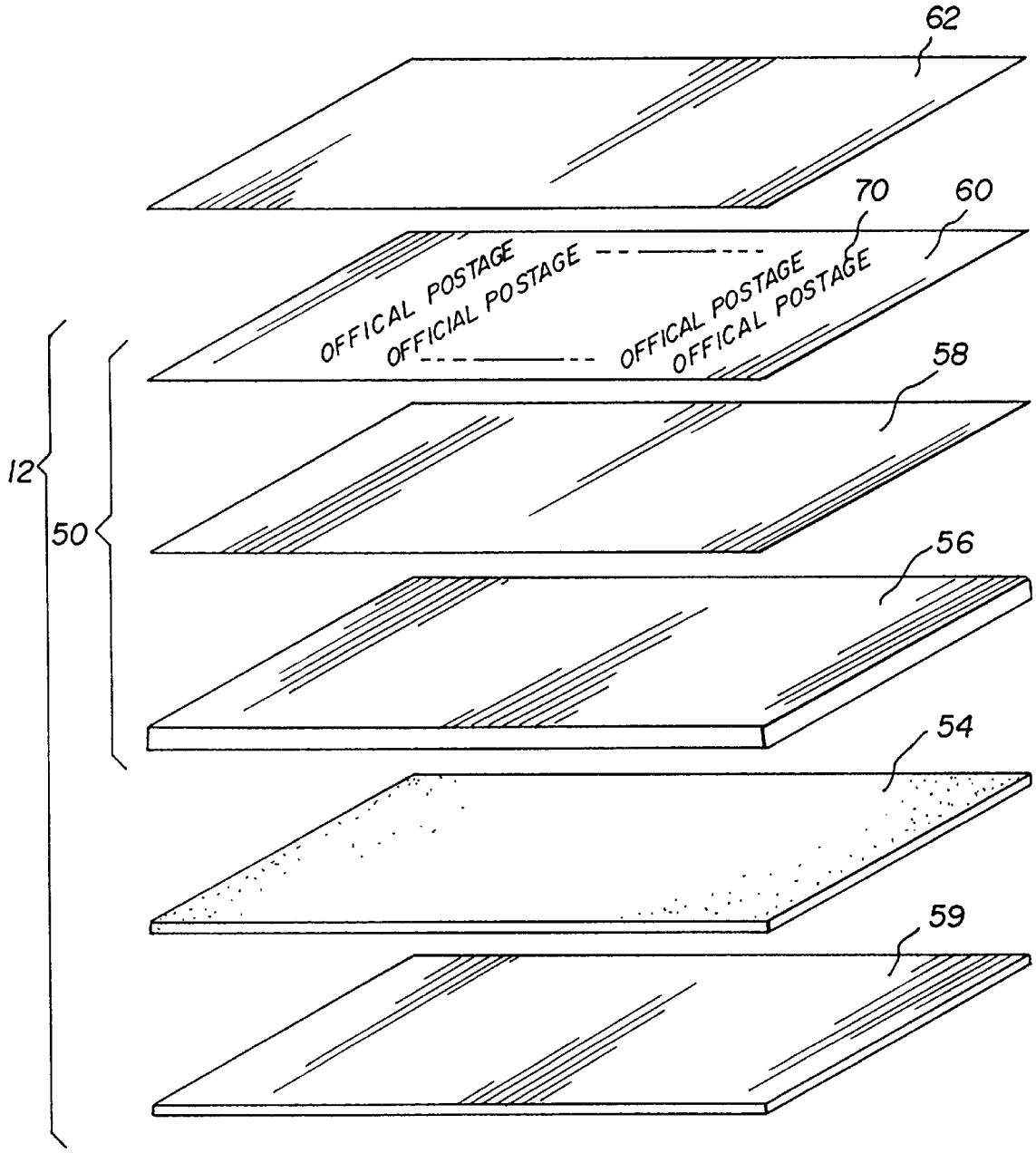
FIG. 2 is an exploded cross-sectional view showing various layers of a receiver in accordance with the present invention.

Now referring to FIG. 2, receiver 12 includes an image receiving structure 50 which is formed on a support 56. The support 56 can be formed of paper or plastic such as polyethylene terephthalate or polyethylene napthalate. Alternatively, it can be in the form of a web. In this embodiment an adhesive layer 54 is provided on the back surface of the support 56. A peelable protective release layer 59 is provided over the adhesive layer 54 until it is to be used for securing the image receiving structure 50 to a surface. This type of construction is particularly suitable when a series of images 90 and the authentic user viewable marks 70 need to be peeled apart for use, e.g., postal stamps. The image receiving structure 50 includes in sequence three layers, the support 56, a barrier layer 58 and the colorant receiving layer 60. At the time of manufacture of the colorant receiving layer 60 authentic user viewable marks 70 are formed on the colorant receiving layer 60 which authenticate images to be formed. These marks can be in the form of a bar code, an official seal, alphanumeric data or encoded digitized information. In operation, a platen 18 is moved into print position by an actuator 20 pressing the receiver 12 against the colorant donor element 14. Actuators are well known in the field and can be provided by a mechanical linkage, solenoid, and small piston arrangement or the like. The colorant donor element 14 includes a series of colorant patches (not shown). These colorant patches can be yellow, cyan and magenta and they are sequentially moved into image transferring relationship with the colorant donor element 14. The result of this process are images 90 formed on the receiver 12.

The colorant donor element 14 is driven along a path from a supply roller 24 onto a take-up roller 26 by a drive mechanism 28 coupled to the take-up roller 26. The drive mechanism 28 includes a stepper motor which incrementally advances and stops the colorant donor element 14 relative to the receiver 12.

A control unit 30 having a microcomputer converts digital signals corresponding to the desired image from a computer 32 to analog signals and sends them as appropriate to the optical system 38 which modulates the laser beam produced by a laser light source 34 and focuses the laser light onto the colorant donor element 14. The laser light source 34 illuminates the colorant donor element 14 and heats such colorant donor element 14 to cause the transfer of colorant to the receiving layer 60 of the image receiving structure 50. This process is repeated until an image 90 is formed on each of the image receiving structures 50. During the final pass a protective layer 62 is then formed on the color receiving layer 60. Alternatively, a plurality of dye donor resistive elements (not shown) which are in contact with the colorant donor element 14. When a dye donor resistive elements is energized it is heated which causes dye to transfer from the colorant donor element 14 to the receiver 12 in a pattern to provide the colored image. For a more complete description of this type of thermal printing apparatus reference is made to commonly assigned U.S. Pat. No. RE 33,260.

Figure 3:
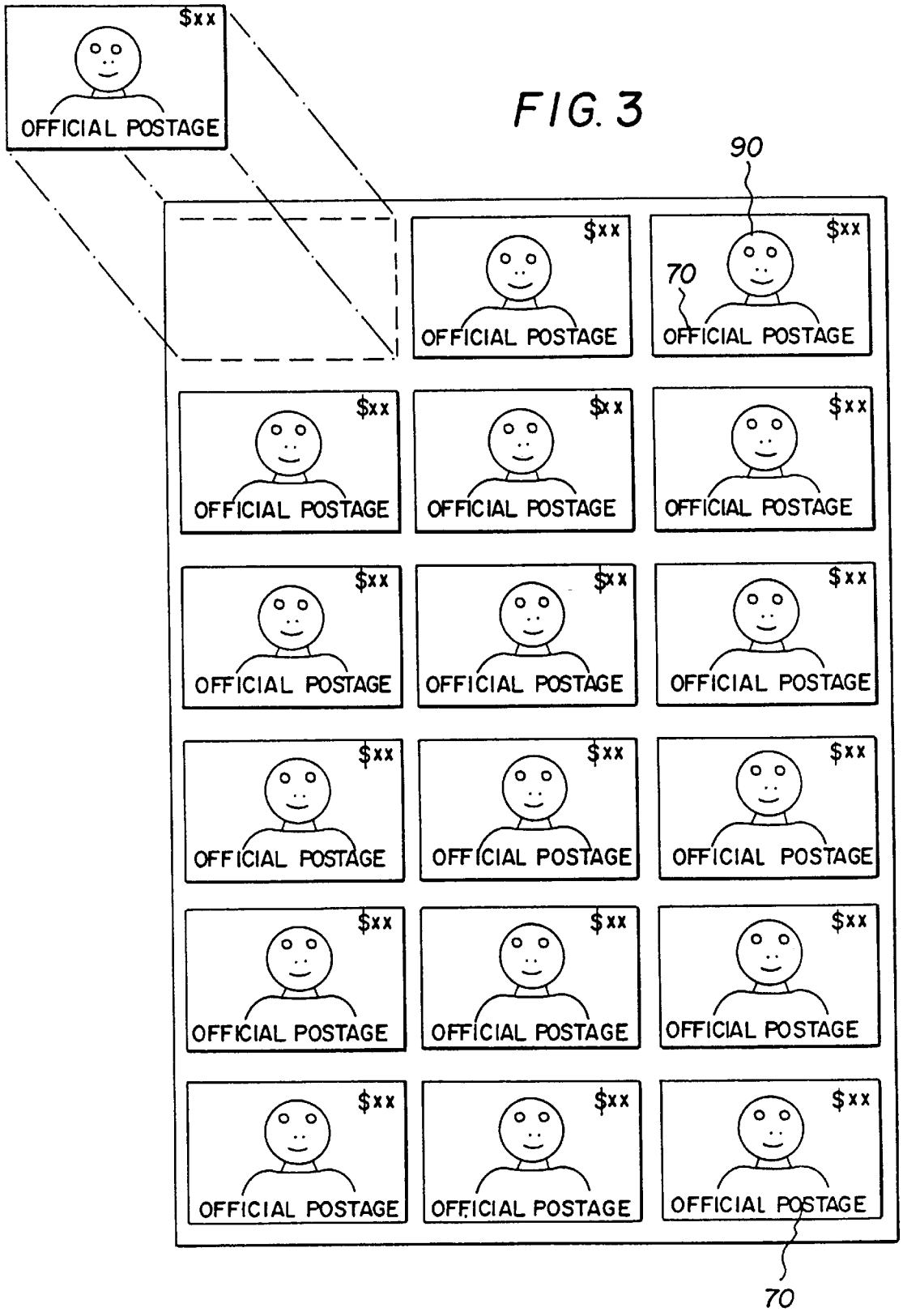
FIG. 3 shows a series of images and marks which authenticate such images in a receiver of FIG. 2.

Turning now to FIG. 3 which shows the output of the printing process which is a series of authentic user viewable marks 70 and an image 90 such as postal stamps. It is desirable that the authentic user viewable marks 70 on the receiver 12 be highly accurate so that they may not be counterfeited. As is well known in the art the receiver 12 in a web form can be run through a gravure process. For that purpose the authentic user viewable marks 70 are created in the receiver 12, when the receiver 12 is in a web form by using a gravure process. The authentic user viewable marks 70 are formed with a high level of detail so that they are difficult to duplicate. The authentic user viewable marks 70 have a high level of detail so that when an image 90 is formed during the thermal printing process, the authentic user viewable marks 70 will be visible indicating to a viewer or reader of the receiver 12 that the images are authentic. The gravure process is capable of creating authentic user viewable marks 70 of very high resolution, well beyond the capabilities of most common printers. The gravure process is an intaglio process. It uses a depressed or sunken surface for the authentic user viewable marks 70. The authentic user viewable marks 70 include cells or welds etched into a copper cylinder and the unetched surface of the cylinder represents the non-printing areas. The cylinder rotates in a bath of ink. Gravure printing is considered excellent for printing highly detailed marks or pictures that create the authentic user viewable marks 70. High cylinder making expense usually limits gravure for long runs. Different types of inks may be used for depositing the authentic user viewable marks 70 by the gravure process as noted later on the receiver 12 which can be used in the thermal printer apparatus 10 of FIG. 1.

Figure 4:
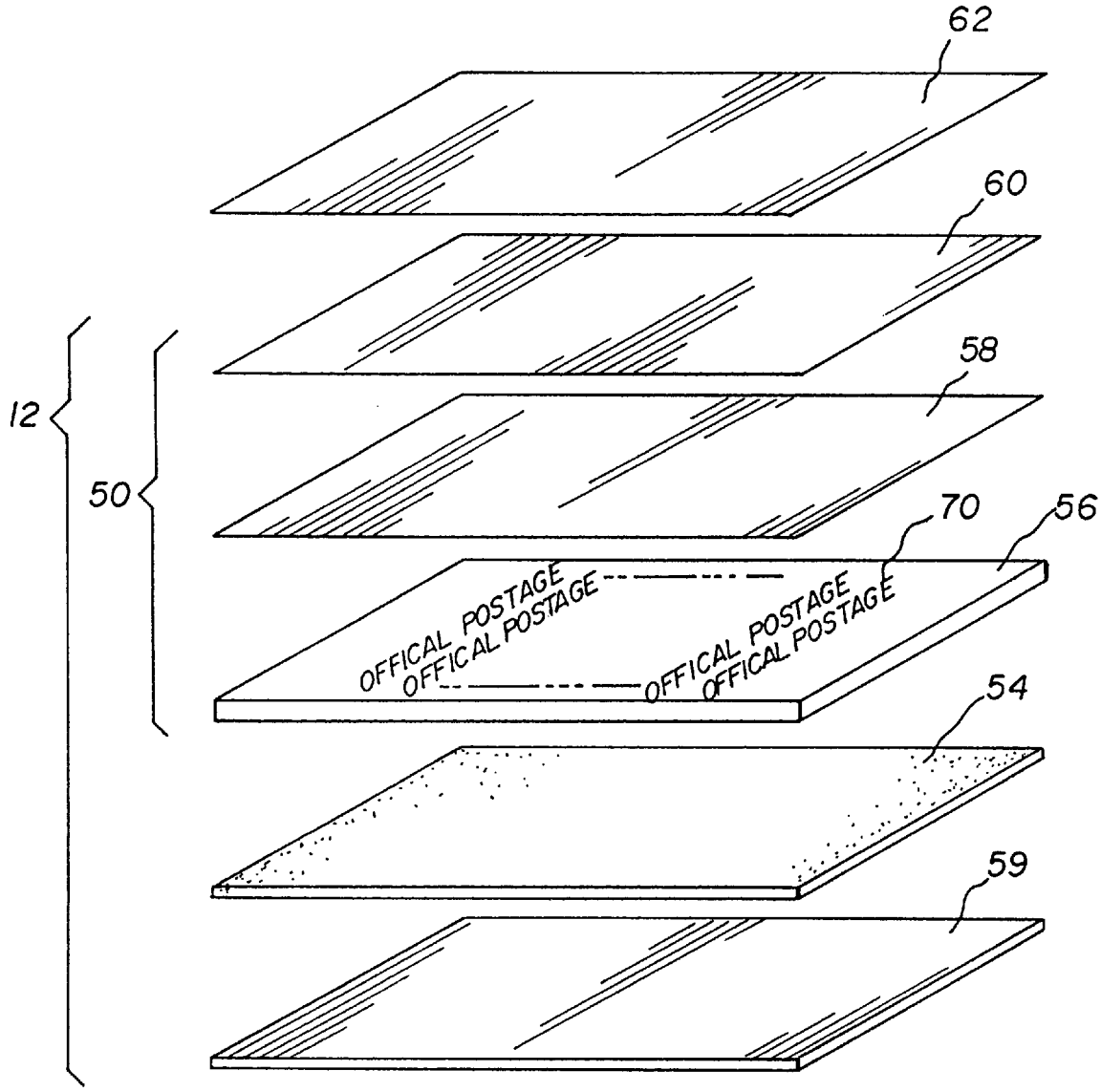
FIG. 4 is an exploded view of an embodiment of a receiver in accordance with the present invention.

At the time of manufacture of the receiver 12 authentic user viewable marks 70 can also be formed on the support 56, as shown in FIG. 4.

The colorants used to form the authentic user viewable marks in the receiver 12 can be inks, dyes or pigments. Inks used in gravure printing are generally solvent based having fluid properties that allow them to fill the wells of the engraved cylinders or plates without spreading outside of these wells, yet are drawn out when contacted by the substrate. The binder solvent used in the formulation is such that the inks dry by evaporation and have good adhesion to the substrate. These inks are well known in the art and are described in detail in the *Graphic Arts Manual*, Arno Press, Musarts Publishing Corp., New York, N.Y., 1980; specifically in the chapters titled "Inks in Common Use", Theodore Lustig, Sun Chemicals Corp. and *Introduction to Printing Inks*, Gary G. Winters, Inmont Corporation.

The marks can be formed of fluorescent materials which fluoresce under certain lighting conditions. When the colorants are inks or dyes of the type that fluoresce and are invisible to the unaided eye as described in commonly assigned U.S. Pat. Nos. 5,752,152; 5,772,250; 5,768,674 and U.S. patent aplication Ser. Nos. 08/598,785; 08/837,931; 08/873,959; the disclosures of which are incorporated by reference. The colorants can be for example comprised of inks or dyes that can be seen using infrared light with a wave length between $10^{-6}$ meters and $10^{-3}$ meters, or colorants comprised of inks or dyes that can be seen using ultraviolet light with a wave length between $10^{-8}$ meters and $10^{-7}$ meters. Alternatively, the marks can be formed from dye from a material which disappears under non-ambient lighting conditions. Various combinations of colorant marks and embossed marks with the colorants formed of different materials will suggest themselves to those skilled in the art.

Figure 5:
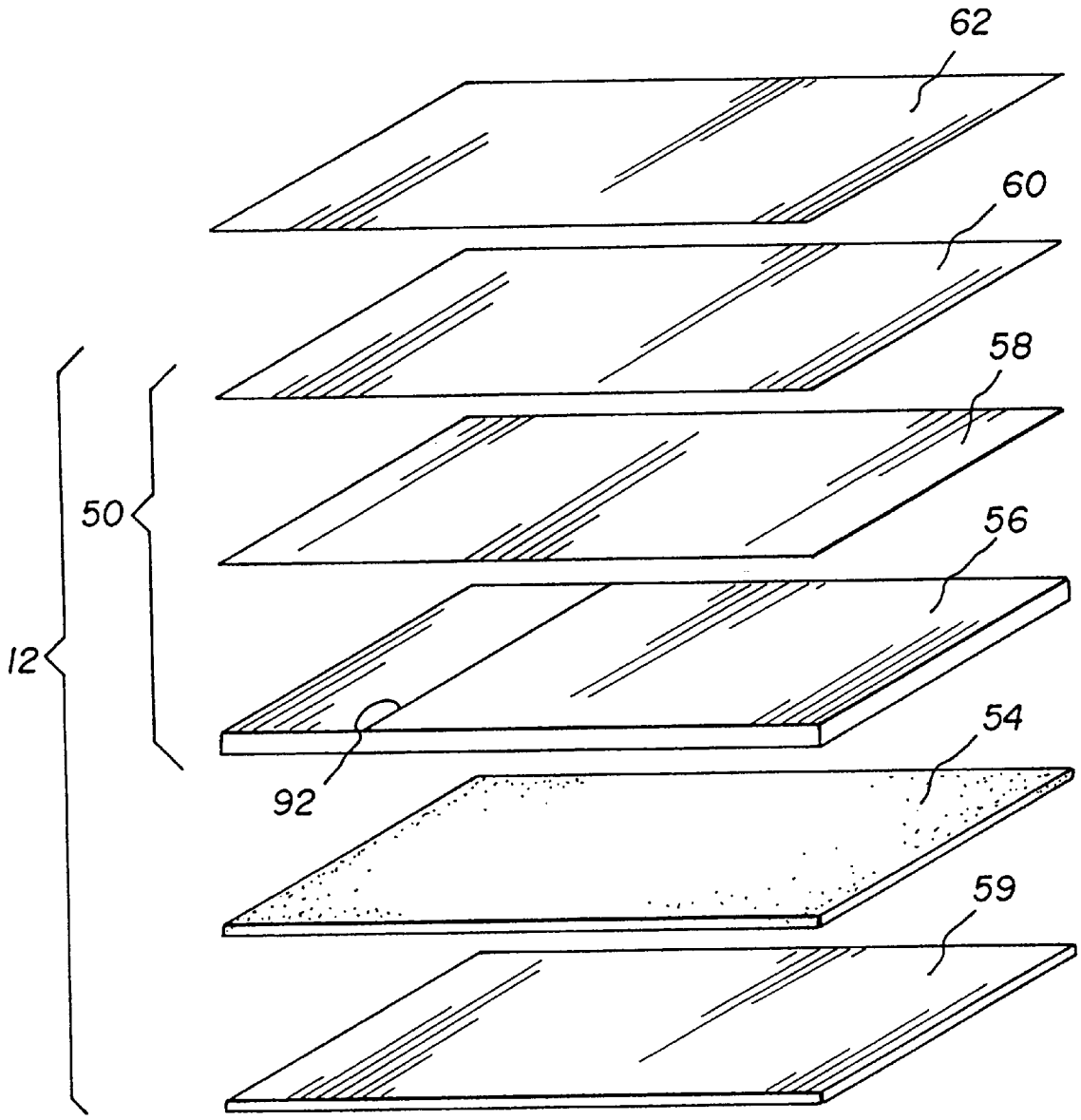
FIG. 5 is an exploded view of another embodiment of a receiver in accordance with the present invention.

Turning now to FIG. 5 which shows the receiver 12 with an authenticating silver impregnated thread 92 in the support 56 of the receiver 12.

Figure 6:
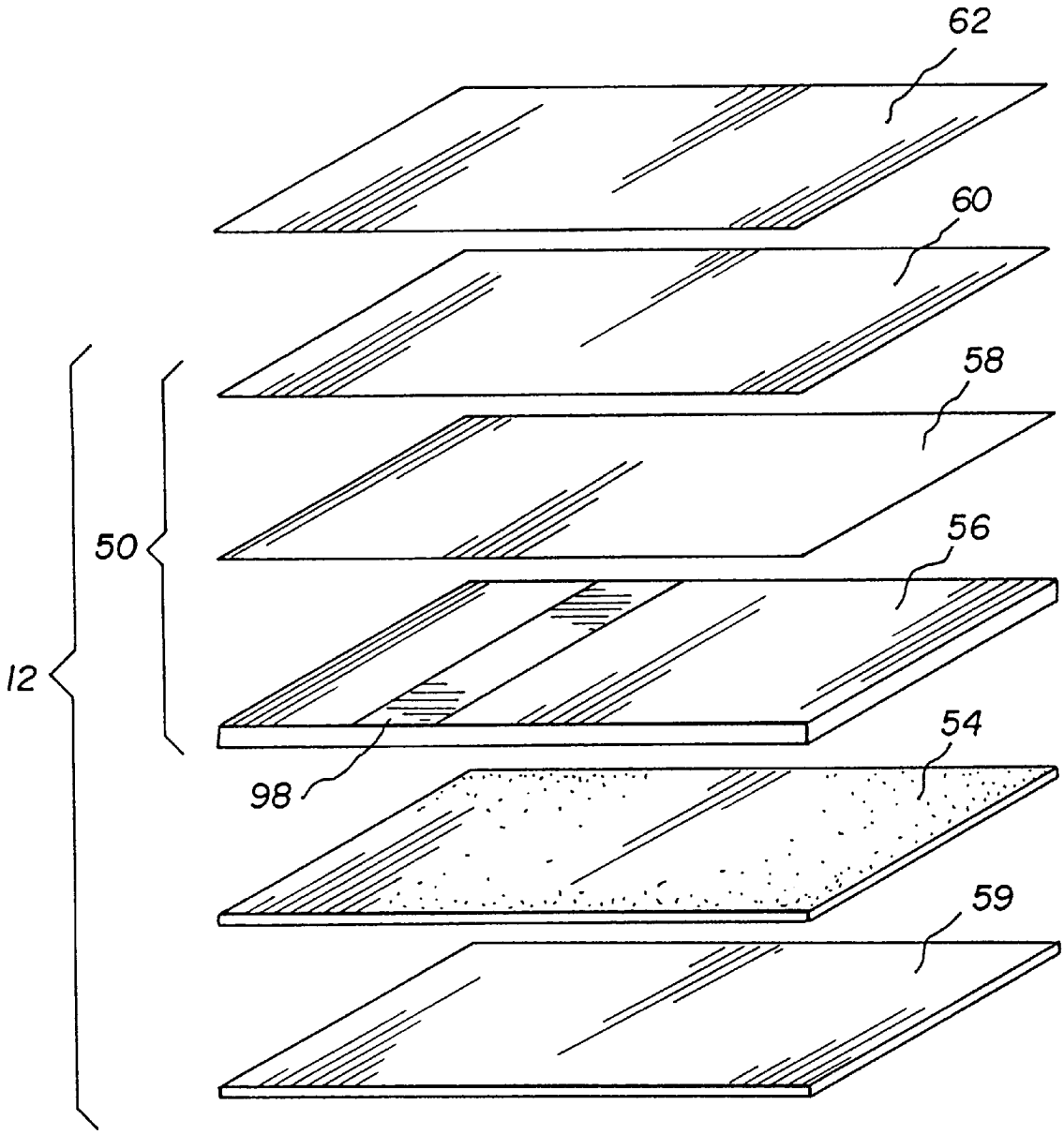
FIG. 6 is a view similar to that of FIG. 5 but showing the use of a magnetic strip which contains authenticating information.

Turning now to FIG. 6 which shows the receiver 12 with an authenticating magnetic strip material 98 in the support 56 of the receiver 12. The magnetic material for example can be iron oxide and the authenticating marks are encoded in the magnetic material as magnetic pulses which can be read and decoded using magnetic read/write heads. The magnetic strip can also be formed from a plastic mixture which further includes a substantially uniform distribution of magnetic particles, as described for example, in the Kodak Product Brochure titled "Inherent Intelligence with the New Magnetic Card System from Kodak", 1995.

Figure 7:
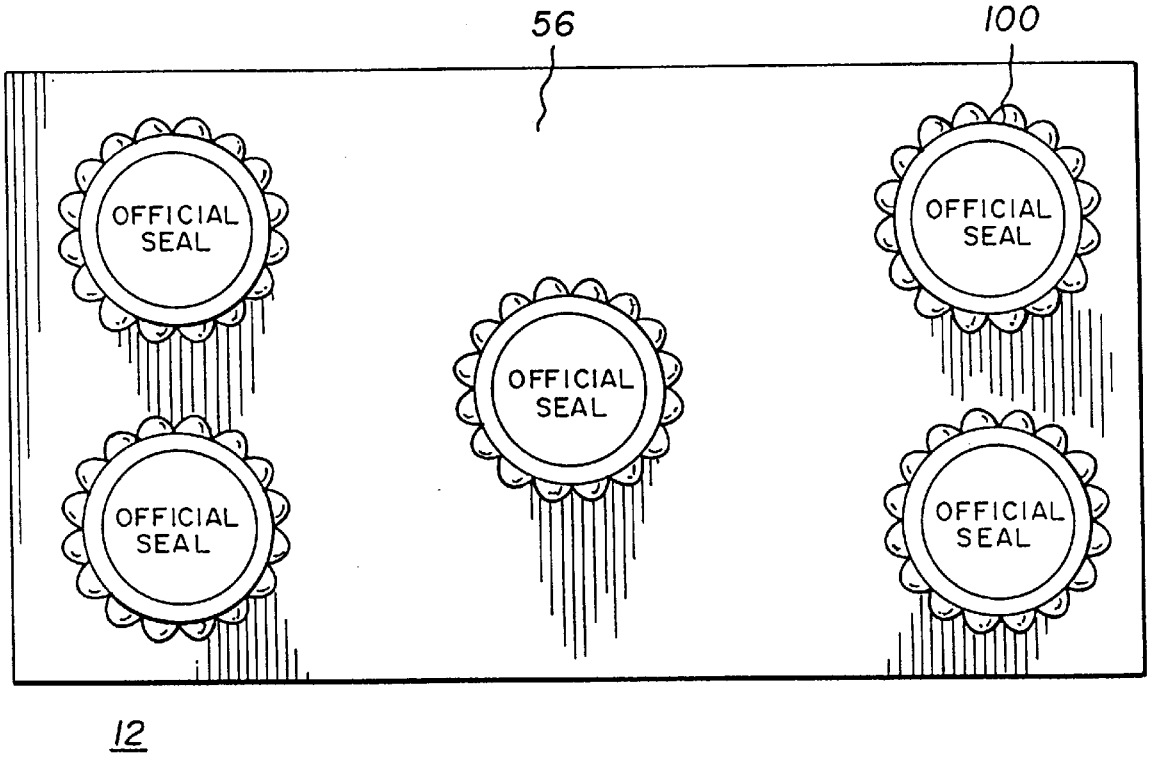
FIG. 7 shows a series of marks which provide water marks in accordance with the present invention.

Turning now to FIG. 7 which shows the receiver 12 with the authentic user viewable marks forming an authenticating type seal in the support 56 of the receiver 12. The authentic user viewable marks can be in the form of water marks 100 that appear under special lighting conditions such as when the receiver is help up to a light source.

Figure 8:
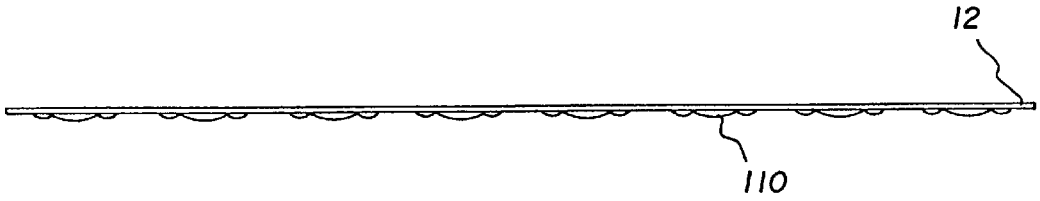
FIG. 8 show a series of embossed authenticating marks.

Turning now to FIG. 8 which shows the receiver 12 with the authentic user viewable marks embossed into the support 56 of the receiver 12 forming a tactile indicia 110 as the means authenticating the image.

The invention has been described in detail with particular reference to certain preferred embodiments thereof, but it will be understood that variations and modifications can be effected within the spirit and scope of the invention.

| PARTS LIST | |
|---|---|
| 10 | thermal printer apparatus |
| 12 | receiver |
| 14 | colorant donor element |
| 16 | tray |
| 18 | platen |
| 20 | actuator |
| 24 | supply roller |
| 26 | take-up roller |
| 28 | drive mechanism |
| 30 | control unit |
| 32 | computer |
| 34 | laser light source |
| 38 | optical system |
| 50 | image receiving structure |
| 54 | adhesive layer |
| 56 | support |
| 58 | barrier layer |
| 59 | peelable protective release layer |
| 60 | colorant receiving layer |
| 62 | protective layer |
| 70 | viewable marks |
| 90 | images |
| 98 | strip material |
| 110 | tactile indicia |

What is claimed is:

1. A receiver having an image receiving structure with authentic user viewable marks and to which a series of viewable images such as postal stamps adapted to be transferred, the image receiving structure comprising:

a) a support having first and second surfaces and including a series of authentic user viewable marks the support includes at least one silver impregnated thread;

b) a barrier layer formed on the first surface of the support;

c) a colorant receiving layer formed on the barrier layer to which a series of images can be transferred;

d) an adhesive layer formed on the second surface of the support; and e) a peelable release layer formed on the adhesive layer.

2. The receiver of claim 1 wherein the authentic user viewable marks include at least one water mark corresponding to each image of the series.

3. The receiver of claim 1 wherein the authentic user viewable marks include magnetic strip material containing authenticating information.

4. The receiver of claim 1 wherein the authentic user viewable marks include a watermark containing authenticating information.

5. The receiver of claim 1 wherein the authentic user viewable marks include tactile indicia containing authenticating information.

6. The receiver of claim 1 further including marks which are formed of a material which disappears under non-ambient lighting.

* * * * *